United States Patent [19]

Baltscheffsky et al.

[11] 4,336,700

[45] Jun. 29, 1982

[54] CYLINDER LOCK

[75] Inventors: Arne Baltscheffsky, Kauniainen; Alpo Kärkkäinen, Kulbo, both of Finland

[73] Assignee: Oy Wartsila Ab, Helsinki, Finland

[21] Appl. No.: 114,369

[22] Filed: Jan. 22, 1980

Related U.S. Application Data

[63] Continuation of Ser. No. 904,513, May 10, 1978, abandoned.

[30] Foreign Application Priority Data

May 24, 1977 [FI] Finland ..... 771639

[51] Int. Cl.[3] ..... E05B 29/00

[52] U.S. Cl. ..... 70/366; 70/403

[58] Field of Search ..... 70/365, 366, 377, 403

[56] References Cited

U.S. PATENT DOCUMENTS

| | | | |
|---|---|---|---|
| 1,545,046 | 7/1925 | Epstein | 70/366 |
| 2,648,973 | 8/1953 | Spain | 70/366 |
| 3,789,638 | 2/1974 | Roberts | 70/366 |
| 3,797,290 | 3/1974 | Taylor | 70/366 |
| 3,905,213 | 9/1975 | Roberts | 70/368 |
| 3,928,992 | 12/1975 | Talbot | 70/366 |

*Primary Examiner*—Robert L. Wolfe

*Attorney, Agent, or Firm*—McAulay, Fields, Fisher, Goldstein & Nissen

[57] ABSTRACT

A cylinder lock comprising a non-rotatable cylinder housing and therein a key operated lock mechanism including a turnable cylinder and a plurality of movable locking discs. When the locking discs are in their zero position, that is, their normal position before the key is inserted into the lock, they keep the lock mechanism in a locked position, in which the cylinder is prevented from turning relatively to the cylinder housing. The locking discs are movable by the key to a cylinder releasing position, and the key forces the locking discs back to their zero position after operation of the lock mechanism. There are spring means arranged to urge at least some of the locking discs in a direction away from their cylinder releasing position towards their zero position. With respect to the normal function of the lock mechanism these spring means are functionally redundant. Their only function is to provide an improved security against lock picking. It is of special advantage to apply the invention to a lock, in which the movement of the locking discs is a turning movement and the locking discs are brought to their cylinder releasing position and back to their zero position by a turning movement of the key.

22 Claims, 7 Drawing Figures

CYLINDER LOCK

Figure 1:
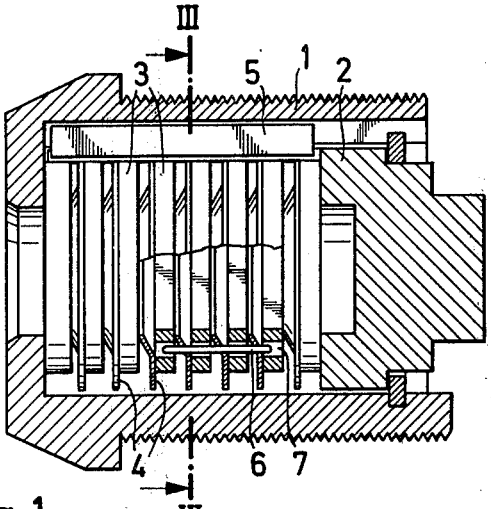

This is a continuation of application Ser. No. 904,513, filed May 10, 1978 and now abandoned.

The invention relates to a cylinder lock comprising a fixed cylinder housing and therein a turnable cylinder having a plurality of locking discs which are movable by the key of the lock and which in their zone position, that is, the key insertion position, prevents the cylinder from turning relatively to the cylinder housing, but which by the key can be moved or turned into a position releasing the cylinder.

One problem in cylinder locks is how to bring back the locking discs or the corresponding elements from their cylinder releasing position to their zero position. In high security locks this movement is positively guided by the turning movement of the key or by the withdrawal of the key from the lock. However, in very many lock types it is not possible to arrange a positively guided zero setting of the locking elements, instead the zero setting is carried out by springs and is thus dependent on the function of the springs. These so called return springs easily cause functional disturbances and are, due to their small dimensions, difficult to handle when the lock is to be assembled. For this reason no springs are used in locks where the zero setting of the locking elements is positively guided. A return spring or springs are used only in locks where the use of spring force is unavoidable with respect to the function of the locking mechanism.

The invention is based on the conception that a spring load could be useful also in locks where the zero setting of the locking elements is positively guided. In such a lock it is no requirement that the spring load should act on all the locking elements, neither is it required that the spring load should perform a complete zero setting, because the functional zero setting is positively guided. It is completely sufficient to have a spring load which urges the locking discs away from that position in which they release the locking mechanism, that is, the cylinder. Due to this functionally fully redundant spring load it is practically impossible to open the lock by trying to manipulate the locking elements one by one by means of some other tool than the right key in order to bring them into a cylinder releasing position, because at least some of the locking elements will spring back from this position, and keeping them in the right position would be extremely difficult. This idea has been materialized in the invention which is characterized by the combination that the key, as known per se, is arranged to, upon operating the lock, positively force the locking discs back to their zero position, and that the locking mechanism includes a spring member arranged to urge at least some of the locking discs in a direction away from their cylinder releasing position towards their zero position, said spring member being functionally redundant with respect to the normal function of the cylinder lock mechanism. This combination gives a very much improved security against lock picking.

Since the object of the invention is to improve the security of the lock, it is most favourable to apply the invention to the cylinder lock type with the highest security, the so called turning discs cylinder lock, in which the locking discs are turnable and are brought into a cylinder releasing position and back to their zero position by a turning movement of the key. In such a lock, the zero setting of the locking discs is positively guided and the key cannot be removed from the lock before the locking discs have been brought to their zero position.

In principle, the spring member can be designed in many alternative ways. It may receive the necessary reaction force from the locking discs, from so called intermediate discs located between the locking discs, or from the cylinder. The different alternatives encompass several practical application possibilities. The alternative solutions are in many cases technically equally good. Their advantages and drawbacks are dependent, in the first line, on the embodiment chosen. The said principles can be applied to a construction in which the spring is placed in a duct formed by openings in the locking discs. In this case one end of the spring can be attached to the bottom of the cylinder or the spring can receive its reaction force therefrom in another way than through a real attachment. Alternatively, the spring may receive its reaction force from the locking discs and/or from the intermediate discs, for instance, in the same way as the functionally necessary return spring 42 shown in U.S. Pat. No. 3,789,638.

A spring member according to the invention can also with advantage be located between the locking discs and the cylinder. This can be made so that a recess is made in the locking discs and/or in the inner surface of the cylinder, which recess receives the spring member. According to a favourable variation of this idea the spring member is placed in an opening in the wall of the cylinder which is usually present for receiving radial protrusions of the locking discs limiting their turning angle. In this case, the spring member may receive its reaction force from the border of the said opening and it may act directly on said protrusions of the locking discs. This construction gives the advantage that it does not require substantial changes in the locking discs and in the cylinder of a conventional lock. As to its form the spring member can be the same kind of Z-formed spring as the already mentioned spring presented in U.S. Pat. No. 3,789,638, but in the embodiment referred to, it is placed at the outer edge of the locking discs. The spring member can be made axially so short that it does not act on all the locking discs, but some of the locking discs are given the possibility of turning so far that their movement limiting protrusion transmits torque from the key through the locking discs to the cylinder. Alternatively, the protrusions of these locking discs can be made narrower, so that a corresponding force transmission is obtained when the spring member has been completely compressed.

It is also feasible that each spring loaded locking disc has its own spring. This is in principle a rather complicated solution, but it might nevertheless be of advantage, if the springs at the same time are used to replace other elements of the lock. The springs may, for instance, be placed between the locking discs and they may be so formed that they can replace the intermediate discs which are usually used between the locking discs in a turning disc cylinder lock. In a normal lock, the intermediate discs are axially somewhat flexible and the springs replacing the intermediate discs can easily be given the same axial flexibility by forming them so that they are somewhat bent in the axial direction of the lock.

In a conventional lock, the object of the intermediate discs is to prevent transmission of the turning movement of one locking disc due to friction to the adjacent locking disc. For this reason, the intermediate discs are non-rotatably fitted in the cylinder. If the intermediate discs are replaced by springs acting on the locking discs, these springs should be dimensioned so that the returning force of the spring is greater than the turning force possibly transmitted by friction through the spring from one locking disc to another.

Figure 2:
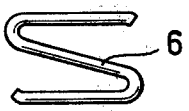
Figure 3:
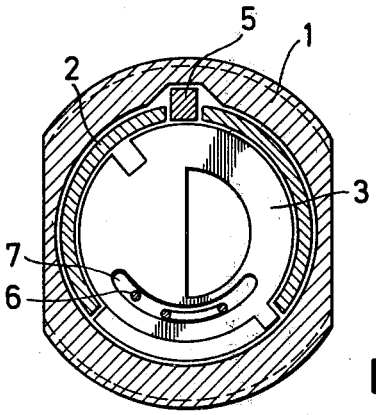
Figure 4:
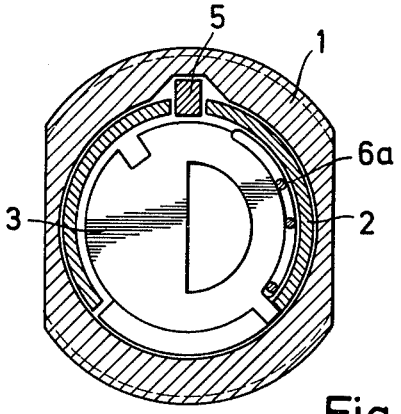
Figure 5:
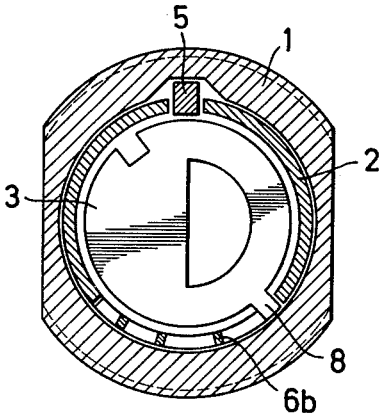
Figure 6:
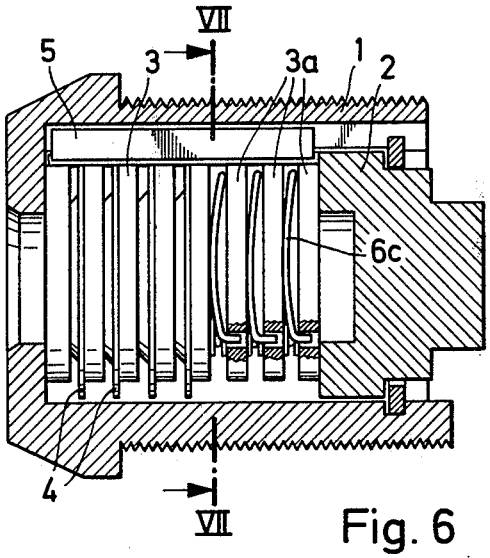
Figure 7:
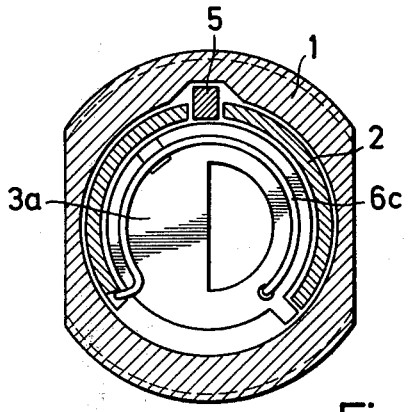

In the following, the invention will be described more in detail with reference to the attached drawings in which FIG. 1 shows an axial section of a lock according to the invention, FIG. 2 shows the spring used in a lock according to FIG. 1, FIG. 3 shows section III—III of FIG. 1, FIG. 4 shows a cross section corresponding to FIG. 3 of another embodiment of the invention, FIG. 5 shows a section corresponding to FIGS. 3 and 4 of a third embodiment of the invention, FIG. 6 shows an axial section of a fourth embodiment of the invention, and FIG. 7 shows section VII—VII of FIG. 6.

In the drawing, the numeral 1 designates the fixed cylinder housing of a lock, 2 the turnable cylinder of the lock, 3 the locking discs of the lock, 4 intermediate discs between the locking discs and 5 a locking bar locking the cylinder 2 to the cylinder housing 1. In the shown embodiment four locking discs close to the bottom of the hollow cylinder 2 function under the influence of a spring load. The spring load is provided by a Z-formed spring 6, the form of which is shown in FIG. 2. FIG. 3 shows that the spring 6 is placed in a duct 7 formed in the locking discs and the intermediate discs.

FIG. 4 shows an embodiment in which a spring member 6*a* is located between the locking discs 3 and the cylinder 2. The spring may as to its form be similar to the one shown in FIG. 2. In this case as well as generally when the spring load is arranged to act in the pile of locking discs, care must be taken that the spring in no functional phase of the lock urges the locking discs over their cylinder releasing position in a direction away from their zero position. This can easily be obtained by taking advantage of nonturnable locking discs, intermediate discs or other suitable elements.

In the embodiment shown in FIG. 5, a spring member 6*b* is located to an opening in the cylinderical wall of the cylinder 2 which receives radial protrusions 8 of the locking discs for limiting the turning angle of the locking discs. Also in this case a Z-formed spring is used, but the cross section of this spring has the form of a flat rectangle in order to obtain a greater compressibility.

FIG. 6 shows an embodiment in which each spring loaded locking disc 3*a* has a separate spring 6*c*. The spring is backed up by the cylinder 2 as best shown in FIG. 7. In the embodiment shown, the springs 6*c* replace the intermediate discs 4 used between the locking discs 3 in conventional locks. In the lock shown in FIG. 6 there are five conventional locking discs 3 without a spring load and three spring loaded locking discs 3*a*. Consequently, it is possible to use, in the same lock, conventional locking discs as well as spring loaded locking discs. If every spring loaded locking disc has its own spring, the spring loaded locking disc can be used in any position in the locking disc pile and also their number can be freely varied.

An ordinary intermediate disc 4 is somewhat flexible in the axial direction of the lock. The corresponding flexibility can be obtained by bending the springs 6*c* acting as intermediate discs somewhat also in the axial direction of the lock as shown in FIG. 6. The spring 6*c* carries out a small turning movement together with the corresponding spring loaded locking disc 3*a* which movement due to friction influences the adjacent locking disc. This, however, does not cause disturbances in the function of the lock if also the adjacent locking disc is spring loaded, because its spring load is greater than the said friction force. Only in a case where the adjacent locking disc which is under the influence of the frictional turning movement of the spring is a conventional locking disc without spring load, the movement of the spring might cause functional disturbances. In order to avoid this an extra flat intermediate disc should be used inbetween or the spring loaded locking disc should be so arranged that the adjacent locking disc without spring load is either a fixed locking disc or a locking disc with a maximum turning angle, whereby said friction influence does not cause disturbances.

The invention is not limited to the embodiments shown, but several modifications thereof are feasible within the scope of the attached claims.

We claim:

1. A cylinder lock comprising a lock mechanism with a mechanically positively guided function independent of any spring means, said mechanism comprising a non-rotatable cylinder housing having therein a key operated lock mechanism including a turnable cylinder and a plurality of locking discs which are turnable by a key and which, when being in a position allowing insertion of said key into said lock, hereinafter called zero position, keeps said lock mechanism in a locking position, thereby preventing said cylinder from turning relatively to said cylinder housing, said locking discs being turnable to a cylinder releasing position, said mechanism further including spring means operative to urge at least some of said locking discs in a direction away from their cylinder releasing position towards their zero position, said spring means being functionally redundant with respect to the normal function of said lock mechanism.

2. A lock as claimed in claim 1, in which said spring means has a spring action support point at a number of said locking discs.

3. A lock as claimed in claim 1, in which said spring means has a spring action support point at a number of intermediate discs arranged between said locking discs.

4. A lock as claimed in claim 1, in which said spring means has a spring action support point at said cylinder.

5. A lock as claimed in claim 1, in which said spring means is arranged in a duct formed by openings in said locking discs.

6. A lock as claimed in claim 1, in which said spring means is located between said locking discs and said cylinder.

7. A lock as claimed in claim 1, in which said spring means is placed in an opening of a cylindrical wall portion of said cylinder, said opening receiving radial protrusions of said locking discs for limiting the turning angle of said locking discs.

8. A lock as claimed in claim 1, in which said spring means includes several separate spring elements located between at least some of said locking discs.

9. A lock as claimed in claim 8, in which said separate spring elements act as separating elements between said locking discs.

10. A lock as claimed in claim 9, in which said separate spring elements are slightly curved in the axial direction of said cylinder, thereby providing some axial flexibility.

11. A lock as claimed in claim 1, in which said spring means operatively influences only some of said locking discs.

12. A lock as claimed in claim 7, wherein said spring means includes a Z-shaped spring having a flat rectangular cross-section.

13. A lock as claimed in claim 1, including an intermediate disc between each adjacent pairs of said locking discs, some of said adjacent pairs of said locking discs and said intermediate discs therebetween having an opening which together form a duct, and said spring means including a spring in said duct.

14. A cylinder lock comprising a non-rotatable cylinder housing having therein a key operated lock mechanism including a turnable cylinder and a plurality of locking discs which are turnable by a key and which, when being in a position allowing insertion of said key into the lock, hereinafter called zero position, keeps said lock mechanism in a locking position, thereby preventing said cylinder from turning relatively to said cylinder housing, said locking discs being turnable to a cylinder releasing position, said key being provided with means for positively forcing said locking discs back to their zero position after operation of said lock mechanism, said mechanism further including several spring elements between at least some of said locking discs acting as separating elements therebetween operative to urge at least some of said locking discs in a direction away from their cylinder releasing position towards their zero position, the urging action of said spring elements being functionally redundant with respect to the normal function of said lock mechanism.

15. A lock as claimed in claim 14, in which said spring elements are curved in the axial direction of said cylinder.

16. A lock as claimed in claim 15, including means operatively associated with the other locking discs free of said spring means to prevent functional disturbances in the lock.

17. A lock as claimed in claim 16, wherein said last-mentioned means includes intermediate discs located between said other of said locking discs.

18. A cylinder lock comprising a non-rotatable cylinder housing having therein a key operated lock mechanism including a turnable cylinder and a plurality of locking discs which are turnable by a key and which, when being in a position allowing insertion of said key into said lock, hereinafter called zero position, keeps said lock mechanism in a locking position, thereby preventing said cylinder from turning relatively to said cylinder housing, said locking discs being turnable to a cylinder releasing position, said key being provided with means for positively forcing said locking discs back to their zero position after operation of said lock mechanism, said mechanism further including an operable spring element in contact with some of said locking discs operative to urge at least said some of said locking discs in a direction away from their cylinder releasing position towards their zero position, said spring element being functionally redundant with respect to the normal function of said lock mechanism.

19. A lock as claimed in claim 18, in which said spring element is arranged in a duct formed by openings in said locking discs.

20. A lock as claimed in claim 18, in which said spring element is located between said locking discs and said cylinder.

21. A lock as claimed in claim 18, in which said spring element is placed in an opening of a cylindrical wall portion of said cylinder, said opening receiving radial protrusions of at least some of said locking discs for limiting the turning angle thereof.

22. A cylinder lock comprising a lock mechanism with a mechanically positively guided function independent of any spring means, said mechanism comprising a non-rotatable cylinder housing having therein a key operated lock mechanism including a turnable cylinder and a plurality of locking discs which are turnable by a key and which, when being in a position allowing insertion of said key into said lock, hereinafter called zero position, keeps said lock mechanism in a locking position, thereby preventing said cylinder from turning relatively to said cylinder housing, said locking discs being turnable to a cylinder releasing position, said mechanism further including spring means between only some of said locking discs operative to urge at least some of said locking discs in a direction away from their cylinder releasing position towards their zero position, said spring means being functionally redundant with respect to the normal function of said lock mechanism.

* * * * *